US006803808B2

(12) United States Patent
Wu

(10) Patent No.: US 6,803,808 B2
(45) Date of Patent: Oct. 12, 2004

(54) LOW POWER CURRENT MIRROR CIRCUIT

(75) Inventor: Li-Te Wu, Hsinchu (TW)

(73) Assignee: Winbond Electronics Corp., Hsinchu (TW)

( * ) Notice: Subject to any disclaimer, the term of this patent is extended or adjusted under 35 U.S.C. 154(b) by 0 days.

(21) Appl. No.: 10/671,389

(22) Filed: Sep. 24, 2003

(65) Prior Publication Data

US 2004/0124904 A1 Jul. 1, 2004

(30) Foreign Application Priority Data

Dec. 26, 2002 (TW) ..... 091137551

(51) Int. Cl.[7] ..... G05F 1/10; G05F 3/02

(52) U.S. Cl. ..... 327/538; 327/540; 330/288; 323/315

(58) Field of Search ..... 327/538, 540, 327/541, 543; 323/312, 315; 330/280

(56) References Cited

U.S. PATENT DOCUMENTS 5,099,205 A * 3/1992 Lewyn ..... 330/288
5,180,967 A * 1/1993 Yamazaki ..... 323/315
6,194,956 B1 * 2/2001 Barnes ..... 327/538
6,617,915 B2 * 9/2003 Rajan ..... 327/538

* cited by examiner

*Primary Examiner*—Tuan T. Lam
(74) *Attorney, Agent, or Firm*—Volpe and Koenig, P.C.

(57) ABSTRACT

A current mirror circuit is provided. The circuit includes a resistor having a first terminal connected to a current source, a first transistor having a substrate electrode connected to a drain electrode thereof, a second transistor having a substrate electrode connected to the substrate electrode of the first transistor, a third transistor having a substrate electrode connected to the substrate electrode of the first transistor, and a fourth transistor having a drain electrode for providing an output current.

5 Claims, 6 Drawing Sheets

LOW POWER CURRENT MIRROR CIRCUIT

FIELD OF THE INVENTION

This invention relates to a current mirror circuit, and more particularly to a low power current mirror circuit.

BACKGROUND OF THE INVENTION

Current mirrors are often used in analog circuits for producing an output current identical to an input current. Generally, a simplest current mirror circuit can be completed only through employing two MOS transistors. However, if it really only employs two MOS transistors for a current mirror circuit, the output current might become unstable while the voltage variation becomes more serious. For overcoming this problem, a conventional method is to employ four MOS transistor to complete the current mirror circuit.

Please refer to FIG. 1A which illustrates a conventional current mirror circuit employing four MOS transistors. The current mirror circuit includes a first transistor N1, a second transistor N2, a third transistor N3, a third transistor N3, a fourth transistor N4, a resistor R, an input current source $I_{in}$, a first power supply $V_{ss}$ and a second power supply $V_{dd}$. Meanwhile, the source electrode of the first transistor N1 and the source electrode of the second transistor N2 are coupled to the second power supply $V_{ss}$, the gate electrode of the first transistor N1, the gate electrode of the second transistor N2 and the drain electrode of the third transistor N3 are coupled to a first end of the resistor R, the drain electrode of the fourth transistor N4 is coupled to the drain electrode of the second transistor N2, the gate electrode of the third transistor N3, the gate electrode of the fourth transistor N4 and the second end of the resistor R are coupled to the input current source $I_{in}$ and the input current $I_{in}$ is coupled to the second power supply $V_{dd}$.

Moreover, the source electrode of the third transistor N3 is coupled to the drain electrode of the first transistor N1 and the substrate electrode of the first transistor N2, the substrate electrode of the second transistor N1, the substrate electrode of the third transistor N3 and the substrate electrode of the fourth transistor N4 are coupled to the first power supply $V_{ss}$. Thus, through employing the circuit shown in FIG. 1A, an output current $I_{out}$ which is identical to the input current source $I_{in}$ can be obtained at the output terminal (namely the drain electrode of the fourth transistor N4).

Please refer to FIG. 1B which illustrates another conventional current mirror circuit employing four MOS transistors. The current mirror circuit also includes a first transistor N1, a second transistor N2, a third transistor N3, a third transistor N3, a fourth transistor N4, a resistor R, an input current source $I_{in}$, a first power supply $V_{ss}$ and a second power supply $V_{dd}$. The difference from the current mirror circuit shown in FIG. 1A is the substrate electrode of the third transistor N3 is coupled to the drain electrode of the third transistor N3 and the substrate electrode of the fourth transistor N4 is coupled to the source electrode of the fourth transistor N4, and therefore the operating power thereof is lower than that shown in FIG. 1A.

Although the current source in FIGS. 1A–B can generate a larger output impedance so as to avoid the output current $I_{out}$ from being interfered by the voltage variation, the method employing four transistors must will increase the operating power of the system. It might be okay under a general operating power (such as 5V), but the information products nowadays always employ low voltages for saving electricity so that there exist a necessity to reduce the operating voltage of the system.

Because of the technical defects described above, the applicant keeps on carving unflaggingly to develop a "low power current mirror circuit" through wholehearted experience and research.

SUMMARY OF THE INVENTION

It is an object of the present invention to provide a low power current mirror circuit which allow a low bias gate voltage while maintaining a high output-resistance and output swing range.

It is another object of the present invention to provide a current mirror circuit which employs higher substrate bias voltage than source voltage so as to reduce a threshold voltage and a gate bias voltage due to the body effect.

In accordance with an aspect of the present invention, a current mirror circuit includes a resistor having a first terminal connected to a current source, and a second terminal, a first transistor having a gate electrode connected to the second terminal for receiving a first bias voltage, a source electrode connected to a first power source, and a substrate electrode connected to a drain electrode thereof, a second transistor having a gate electrode connected to the gate electrode of the first transistor, a source electrode connected to the first power source, a substrate electrode connected to the substrate electrode of the first transistor, and a drain electrode, a third transistor having a gate electrode connected to the first terminal of the resistor for receiving a second bias voltage, a source electrode connected to the drain electrode of the first transistor, a substrate electrode connected to the substrate electrode of the first transistor, and a drain electrode connected to the second terminal of the resistor, and a fourth transistor having a gate electrode connected to the gate electrode of the third transistor, a source electrode connected to the drain electrode of the second transistor, and a drain electrode for providing an output current.

Preferably, the current mirror circuit operates under a low bias gate voltage.

Preferably, the first transistor, the second transistor, the third transistor, and the fourth transistor are N-channel metal oxide semiconductor field effect transistors.

Preferably, the first power source is the ground.

Preferably, the current source is connected to a second power source.

The above objects and advantages of the present invention will become more readily apparent to those ordinarily skilled in the art after reviewing the following detailed descriptions and accompanying drawings, in which:

DETAILED DESCRIPTION OF THE PREFERRED EMBODIMENT

In low power circuit applications, it is very important to reduce a gate bias voltage of the MOS transistors which are employed by the current mirror circuit. That's because that once the gate bias voltage is reduced, the operating power will also be automatically reduced. Thus, the present invention set forth a current mirror circuit which can reduce the threshold voltage through providing a substrate bias voltage higher than the source bias voltage.

Figure 2A:
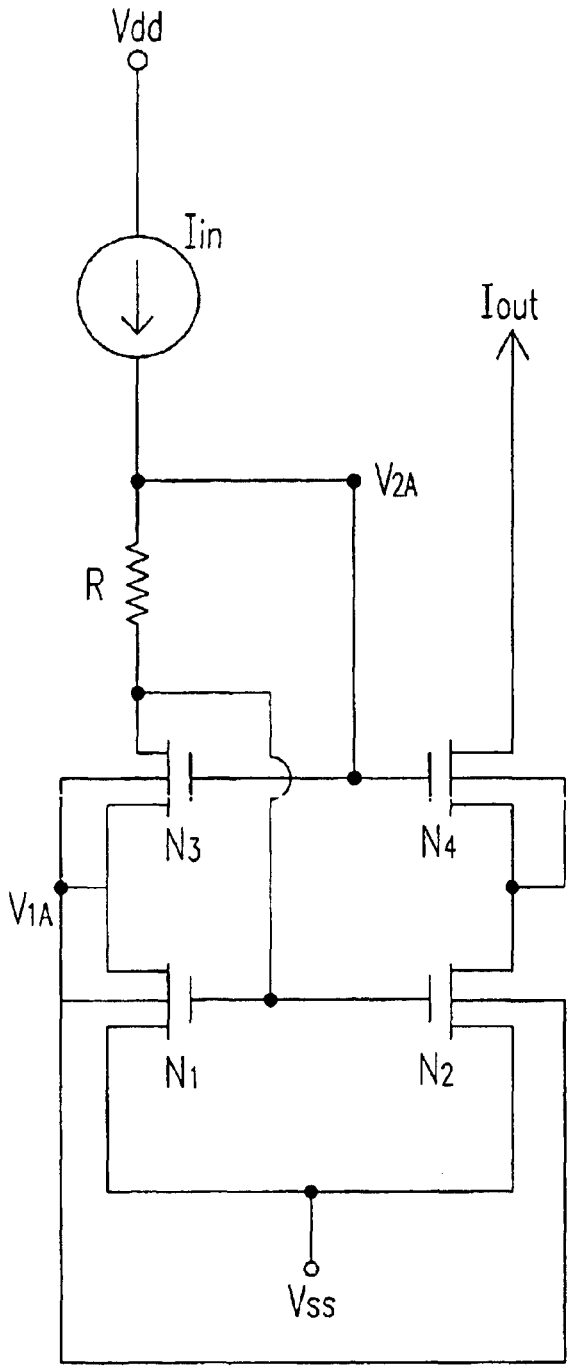
FIG. 2A is a schematic view showing a current mirror circuit in a preferred embodiment according to the present invention.

Please refer to FIG. 2A which illustrates a schematic view of a current mirror circuit in a preferred embodiment according to the present invention. The current mirror circuit is employed to receive an input current $I_{in}$ so as to produce an output current identical to the input current and includes a first transistor N1, a second transistor N2, a third transistor N3, a fourth transistor N4, a resistor R, an input current source $I_{in}$, a first power supply Vss and a second power supply Vdd.

A first end of the resistor R is employed to receive the input current source $I_{in}$. The gate electrode of the first transistor N1 is coupled to the second end of the resistor R to receive a first bias voltage, the source electrode thereof is coupled to the first power supply Vss and the substrate electrode thereof is coupled to the drain electrode thereof. The gate electrode of the second transistor N2 is coupled to the gate electrode of the first transistor N1, the source electrode thereof is coupled to the first power supply Vss and the substrate thereof is coupled to the substrate electrode of the first transistor N1. The gate electrode of the third transistor N3 is coupled to the first end of the resistor R to receive a second bias voltage, the source electrode thereof is coupled to the drain electrode of the first transistor N1, the substrate electrode thereof is coupled to the substrate electrode of the first transistor N1 and the drain electrode is coupled to the second end of the resistor R. The gate electrode of the fourth transistor N4 is coupled to the gate electrode of the third transistor N3, the source electrode thereof is coupled to the drain electrode of the second transistor N2, the substrate electrode thereof is coupled to the source electrode thereof and the output current $I_{out}$ is generated from the drain electrode thereof. Meanwhile, the first power supply Vss is coupled to the ground, and the first transistor N1, the second transistor N2, the third transistor N3 and the fourth transistor N4 are N-type metal-oxide semiconductor transistors.

According to the circuit described above and further based on the body effect, the threshold voltage is equal to:

$$V_{th}=V_{th0}\gamma(\sqrt{V_{SB+|2\phi_F|}}-\sqrt{2\phi_F})$$

Furthermore, because the substrate electrode of the third transistor N3 is coupled to the drain electrode thereof in the present invention, the threshold voltage of the third transistor N3 is equal to $V_{th0}$. Identically, the substrate electrode of the fourth transistor N4 is coupled to the drain electrode thereof, and thus the threshold voltage of the fourth transistor N4 is also equal to $V_{th0}$.

As to the threshold voltage of the first transistor N1, it is equal to:

$$V_{th,N1}=V_{th\text{-}0}+\gamma(\sqrt{V_{SD,N1+2\phi_F}}-\sqrt{2\phi_F})$$

Since the voltage $V_{SD,N1}$ of the first transistor N1 is negative, the threshold $V_{th,N1}$ thereof is lower than $V_{th0}$, which is generally equal to 0.7 V). Depending on the same theory, the $V_{SD,N1}$ of the second transistor N2 is also negative, and thus the threshold $V_{th,N2}$ thereof is lower than $V_{th0}$. Furthermore, both the threshold voltages of the first transistor N1 and the second transistor N2 are the same. Consequently, the gate bias voltage of the first transistor N1 and the second transistor N2 is equal to:

$$V_{g,N1}=V_{g,N2}=V_{th0}+\gamma\left(\sqrt{V_{SD,N1}+|2\phi_F|}-\sqrt{2\phi_F}\right)+\sqrt{\frac{2Iin}{\mu_n C_{ox}}\left(\frac{L}{W}\right)_{N1}}$$

Based on the formula described above, because $V_{SD,N1}<0$, $\gamma(\sqrt{V_{SD,N1+|2\phi_F|}}-\sqrt{2\phi_F}$ is also negative. Therefore, the gate bias voltage of the first transistor N1 and the second transistor N2 can be reduced so as to reduce the operating power of the whole system.

Figure 2B:
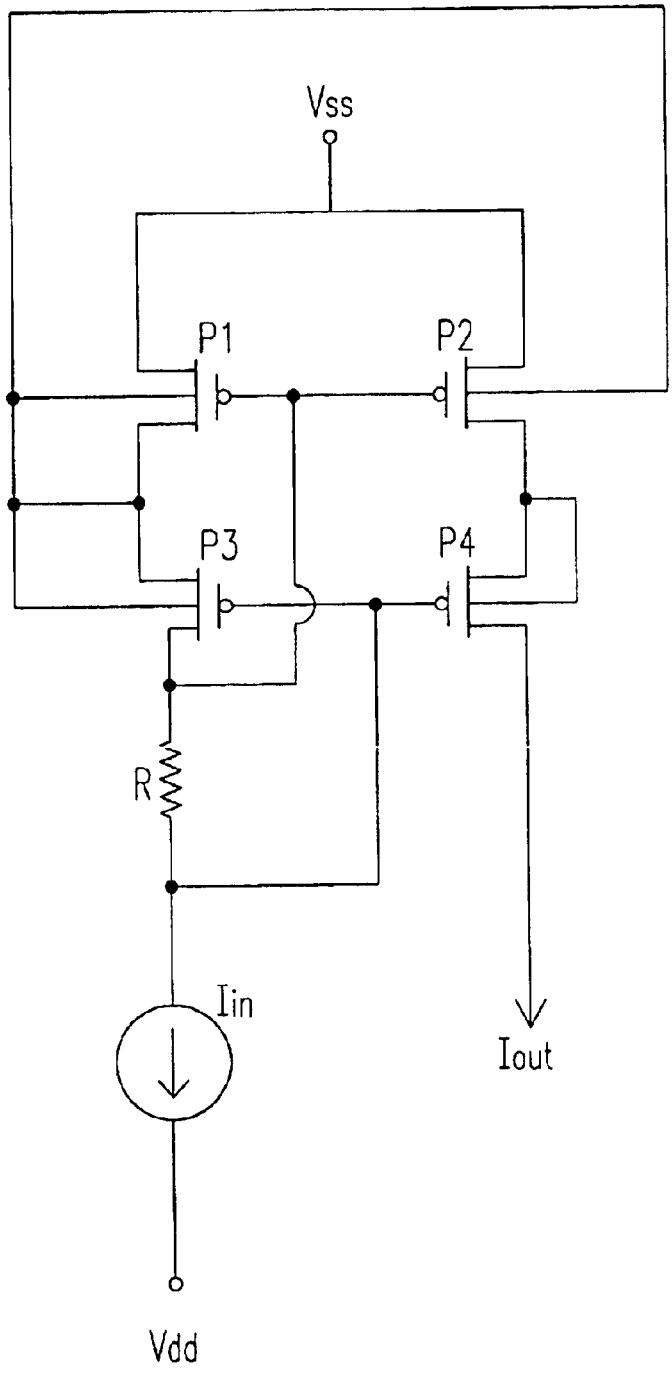
FIG. 2B is a schematic view showing a current mirror circuit in another preferred embodiment according to the present invention.

Another embodiment according to the present invention is shown in FIG. 2B. A current mirror circuit includes a first transistor P1, a second transistor P2, a third transistor P3, a fourth transistor P4, a resistor R, an input current source $I_{in}$, a first power supply Vss and a second power supply Vdd. The difference from that in FIG. 2A is the first transistor P1, the second transistor P2, the third transistor P3 and the fourth transistor P4 are P-type metal-oxide semiconductor transistors.

Figure 1A:
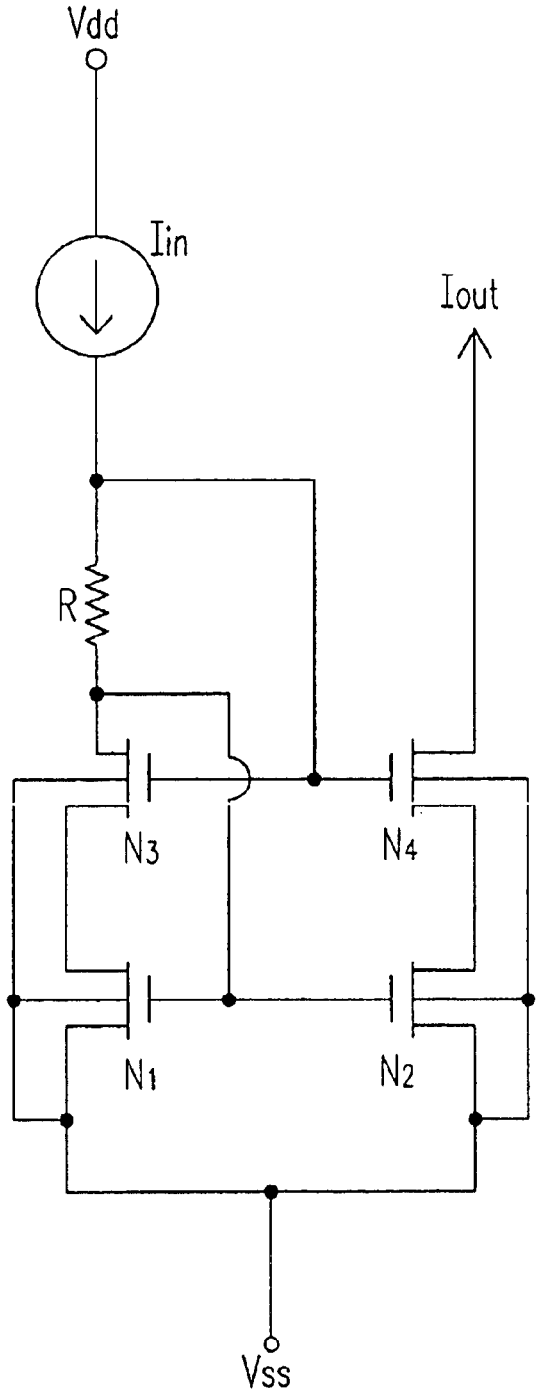
Fig. 1A (PRIOR ART)
FIG. 1A is a schematic view showing a current mirror circuit employing two MOS transistors in the prior art.
Figure 1B:
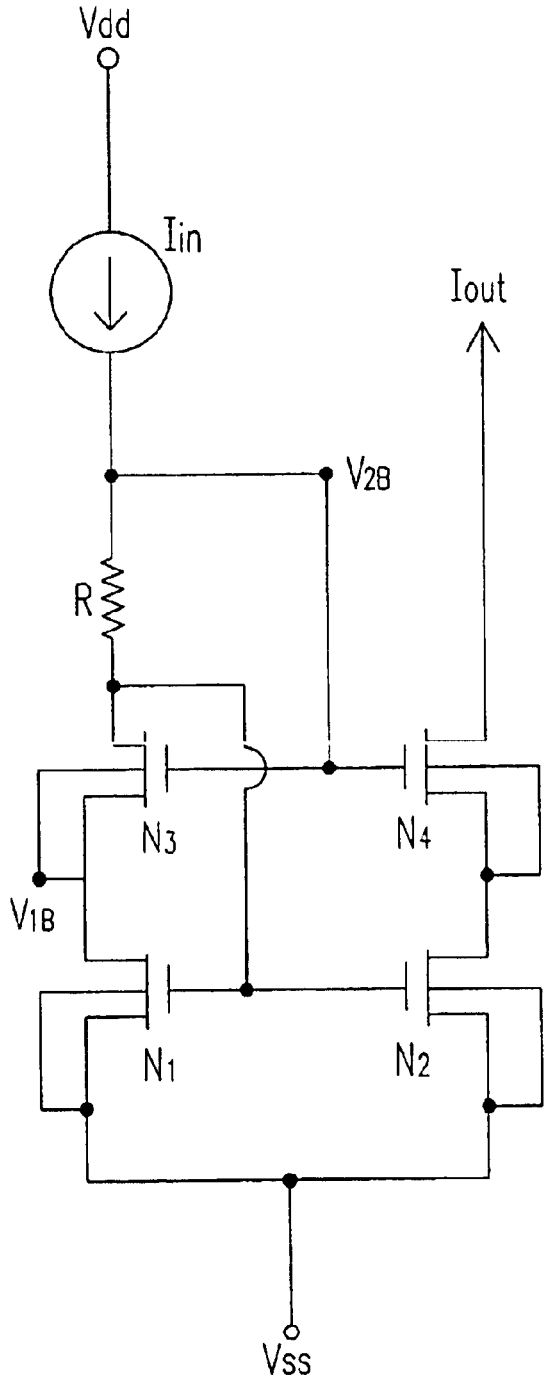
Fig. 1B(PRIOR ART)
FIG. 1B is a schematic view showing a current mirror circuit employing four MOS transistors in the prior art.
Figure 3:
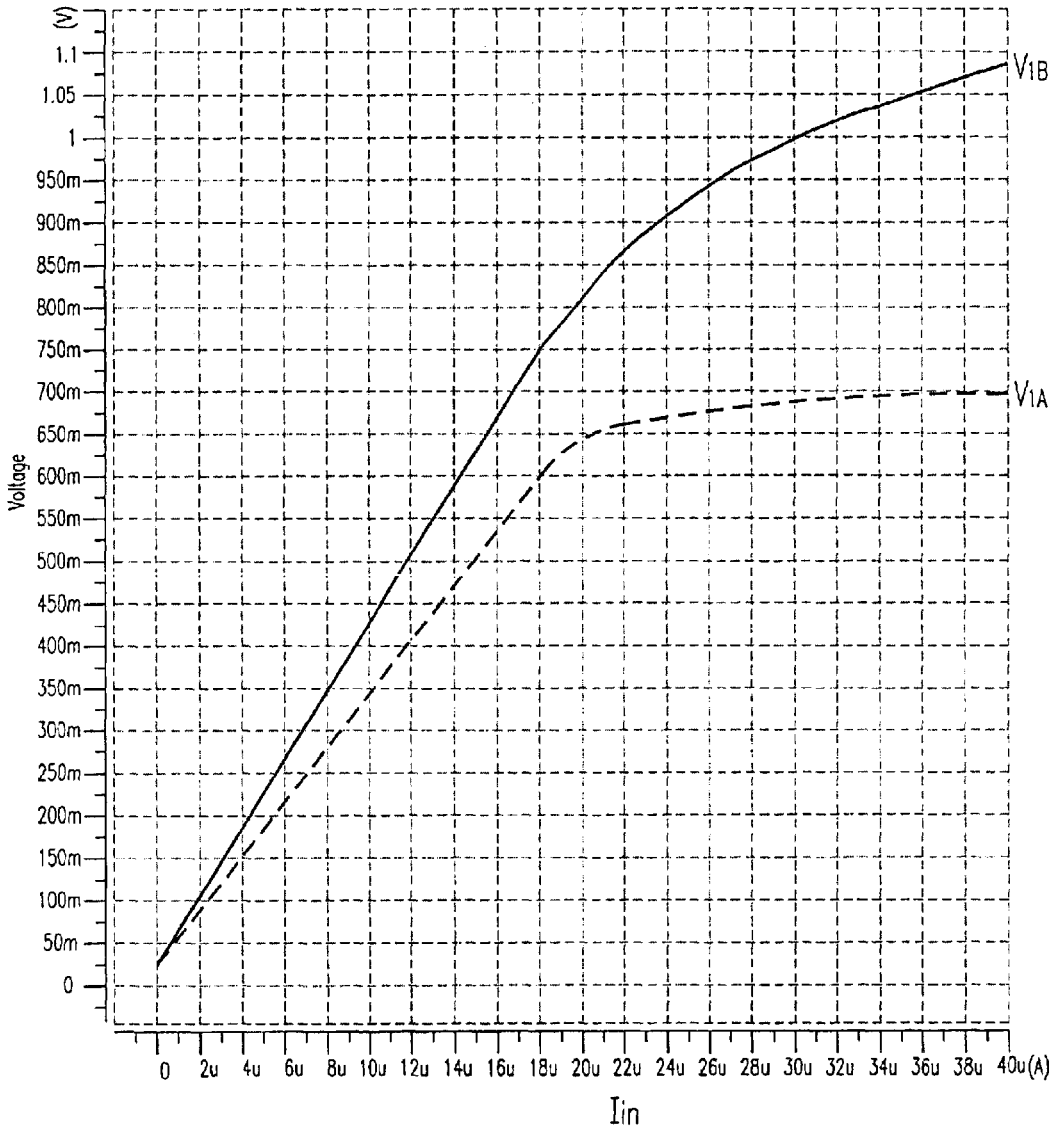
FIG. 3 is a comparison plot of the input current and the measured voltage at a specific point respectively in FIG. 1B and FIG. 2A.

Now, if each element in both FIG. 1B and FIG. 2A is adjusted to suit the input current $I_n$ equal to 10 $\mu$A and R is supposed as 40 kΩ, the result of voltage variation is shown in FIG. 3. The simulation method is to vary the input current from 0 $\mu$A to 40 $\mu$A. As shown in FIG. 3, the node voltage of $V_{1A}$ is restricted under the threshold voltage (0.7 V) of the MOS transistor and when the input current $I_{in}$ is larger than 1.8 mA, because the first transistor N1 and the second transistor N2 shown in FIG. 2A can not maintain a normal function, the current will flow through the drain electrode to the substrate electrode so as to cause a latch-up. However, when in the present invention, the desired input current is equal to 10 $\mu$A, $V_{1A}$ is equal to 0.3 V, and thus the first transistor N1 and the second transistor N2 will not lose efficiency.

Figure 4:
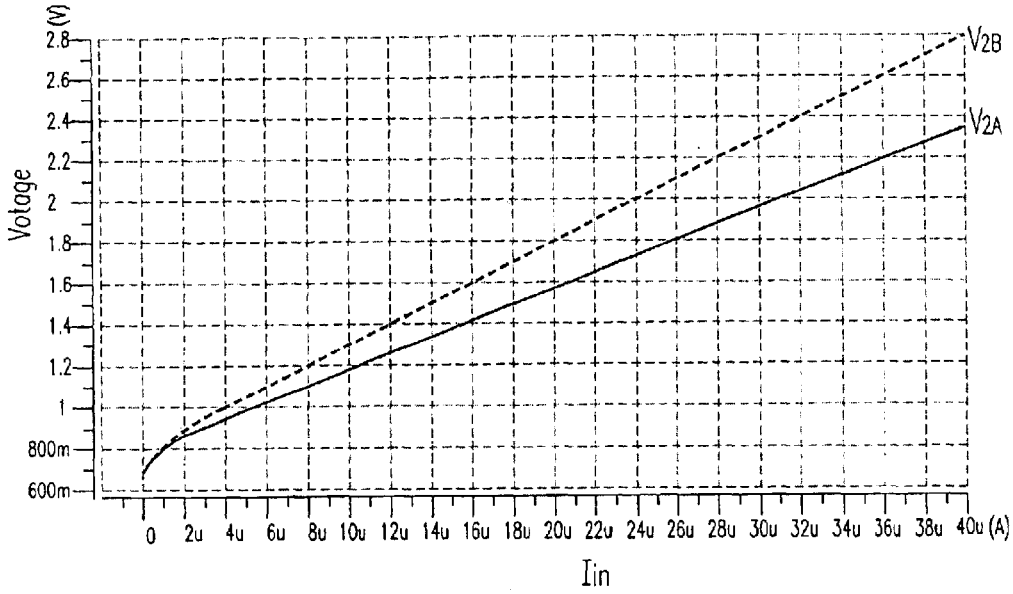
FIG. 4 is a comparison plot of the input current and the measured voltage at another specific point respectively in FIG. 1B and FIG. 2A.

Moreover, the voltage variations of $V_{2B}$ and $V_{2A}$ respectively in FIG. 1B and FIG. 1A are shoves in FIG. 4. As shown in FIG. 4, when the input current $I_{in}$ is equal to 10 $\mu$A, $V_{2A}$ will 150 mV lower than $V_{1A}$. That means, if $V_{SB}$ of the MOS transistor is set as −0.3V, the original threshold voltage will be reduced from 0.75 V to 0.6 V so as to reduce 0.15 V of the operating voltage due to the body effect. A low power operating system like this should be very practical.

Figure 5:
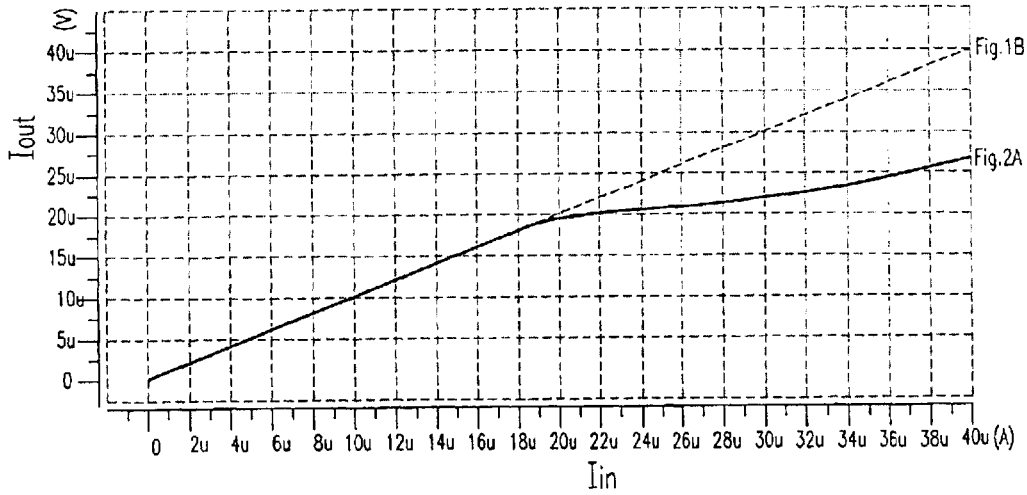
FIG. 5 is a comparison plot of the input current and the output current respectively in FIG. 1B and FIG. 2A.

Please refer to FIG. 5 which is a comparison plot of the input current and the output current in FIG. 1B and FIG. 2A. As shown in FIG. 5, when the input current $I_{in}$ is larger than 18 $\mu$A, part of the current is already flow into the substrate electrode.

In view of the aforesaid, the circuit structure according to the present invention can be employed as the input current is lees variable so that the gate bias voltage of the transistor can be reduced through reducing the threshold voltage thereof so as to reduce the operating voltage of the system. Thus, the present invention can effectively overcome the defects in the prior arts. Consequently, the present invention conforms to the demand of the industry and is industrial valuable.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A current mirror circuit, comprising:

a resistor having a first terminal connected to a current source, and a second terminal;

a first transistor having a gate electrode connected to said second terminal for receiving a first bias voltage, a source electrode connected to a first power source, and a substrate electrode connected to a drain electrode thereof;

a second transistor having a gate electrode connected to said gate electrode of said first transistor, a source electrode connected to said first power source, a substrate electrode connected to said substrate electrode of said first transistor, and a drain electrode;

a third transistor having a gate electrode connected to said first terminal of said resistor for receiving a second bias voltage, a source electrode connected to said drain electrode of said first transistor, a substrate electrode connected to said substrate electrode of said first transistor, and a drain electrode connected to said second terminal of said resistor; and a fourth transistor having a gate electrode connected to said gate electrode of said third transistor, a source electrode connected to said drain electrode of said second transistor, and a drain electrode for providing an output current.

2. The current mirror circuit according to claim 1, wherein said current mirror circuit operates under a low bias gate voltage.

3. The current mirror circuit according to claim 1, wherein said first transistor, said second transistor, said third transistor, and said fourth transistor are N-channel metal oxide semiconductor field effect transistors.

4. The current mirror circuit according to claim 1, wherein said first power source is the ground.

5. The current mirror circuit according to claim 1, wherein said current source is connected to a second power source.

* * * * *